United States Patent [19]

Meyer

[11] Patent Number: 5,035,354

[45] Date of Patent: Jul. 30, 1991

[54] SAFETY DUAL-INTERLOCK SYSTEM FOR FASTENER DRIVING TOOL

[75] Inventor: Robert J. Meyer, Elmwood Park, Ill.

[73] Assignee: Duo-Fast Corporation, Franklin Park, Utah

[21] Appl. No.: 523,704

[22] Filed: May 15, 1990

[51] Int. Cl.[5] ..... B25L 1/04

[52] U.S. Cl. ..... 227/7; 227/130

[58] Field of Search ..... 227/7, 130

[56] References Cited

U.S. PATENT DOCUMENTS

| | | | |
|---|---|---|---|
| 3,464,614 | 9/1969 | Volkmann | 227/8 X |
| 3,519,186 | 7/1970 | Volkmann | 227/8 X |
| 3,784,077 | 1/1974 | Burke, Jr. et al. | 227/8 |
| 4,260,092 | 4/1981 | Austin | 227/8 |

*Primary Examiner*—Paul A. Bell

[57] ABSTRACT

A trigger and safety interlock feature for a fastener driving tool having a power mechanism operable in a fastener driving stroke during which a fastener is driven into a workpiece. The invention comprises a manually operable trigger movable between a rest position and a firing position, a workpiece engageable safety member movable between a standby position and an actuating position, and a control mechanism associated with the power mechanism and the trigger for initiating a drive stroke only when the trigger moves from its rest position to its firing position. The invention features an interlock configuration defined on the trigger and on the safety member for permitting the safety member to move from its standby position to its actuating position only when the trigger is in its rest position; permitting the trigger to move from its rest position to its firing position only when the safety member is in its actuating position; permitting the trigger to return from its firing position to its rest position only when the safety member is in its actuating position; and preventing the safety member from returning from its actuating position to its stand by position while the trigger is in its firing position.

7 Claims, 2 Drawing Sheets

SAFETY DUAL-INTERLOCK SYSTEM FOR FASTENER DRIVING TOOL

BACKGROUND OF THE INVENTION

1. Field of the Invention

The present invention relates generally to an improved safety mechanism for a fastener driving tool and more particularly to a new and improved safety mechanism having two interlock modes to prevent the inadvertent or accidental actuation of the fastener driving tool.

2. Background of the Invention

Portable fastener driving tools have enjoyed immense popularity in light manufacturing sectors for the last four decades. In their normal mode of operation, a fastener driving tool is actuated by air pressure so that a fastener, such as a nail, staple or the like, is ejected into a workpiece during a driving stroke of the tool. The exceedingly high air pressures used, on the order of 100 pounds per square inch, results in the fastener being ejected at a hiqh velocity.

Consequently, the operation of such a portable, hand-held fastener tool can be hazardous if they are not properly used. Attempts at eliminating accidental or inadvertent firing of the tool and personal injuries caused by the tools have been marginally successful. However, the safety mechanisms employed can be overcome. A common safety feature used in such tools includes a workpiece contact tip or nosepiece which, if not depressed, keeps the tool from firing. An efficiency feature of this safety configuration is that as long as the operator keeps the trigger depressed, the operator can continue firing fasteners with successive bumps of the contact tip against the workpiece.

Examples of designs incorporating safety features or mechanisms are disclosed in U.S. Pat. No. 3,784,077 issued on Jan. 8, 1974 and U.S. Pat. No. 4,260,092 issued on Apr. 7, 1981. The safety features disclosed in those patents tend to prohibit the disclosed fastener driving tool from firing if the nosepiece is not depressed first or if the nosepiece is not continually depressed. However, the trigger in these devices may be pivoted or depressed without the nosepiece also being depressed, thereby creating the possibility of accidental firing if the safety features of the nosepiece configuration are compromised through wear or mishandling.

Some prior tools also allow for continued actuation of the tool when the nosepiece only partially returns toward its inactivated, fully extended position, as for example upon recoil after the tool is activated. This causes the tool to recycle and creates the possibility that a fastener inadvertently will be driven, perhaps on top of a previously driven fastener.

A need exists for a safety feature that will not only prevent the trigger from being depressed when the nosepiece is not placed against a workpiece, but also renders the fastener driving tool inactive when the nosepiece is only partially relaxed.

SUMMARY OF THE INVENTION

Accordingly, it is an object of the present invention to provide a portable fastener driving tool which overcomes many of the disadvantages of the prior art.

Another object of the present invention is to provide a double safety mechanism for a portable driving tool that only allows the trigger to be depressed when the safety member is fully engaged with a workpiece.

Still another object of the present invention is to provide a safety mechanism for a portable fastener driving tool that prevents the tool from operating if the tool is not first engaged with a workpiece. This is accomplished by a trigger lock-out mechanism whereby the trigger is not movable unless the tool is first engaged with a workpiece. An advantage of this feature is the requirement imposed on the operator to first engage the tool against the workpiece before depressing the trigger to eject a fastener.

Yet another object of the present invention is to prevent a portable fastener driving tool from being actuated after ejection of a fastener if the safety member does not remain fully depressed against the workpiece. This is accomplished by a trigger lock-in mechanism whereby the trigger is locked into an inactuated position if the tool raises slightly from the workpiece while still remaining in contact with the workpiece. An advantage of this feature is the elimination of inadvertent firing and bad placement of fasteners.

Briefly, the present invention is directed to a trigger and safety mechanism for a fastener driving tool, the tool having a power mechanism operable in a fastener driving stroke during which a fastener is driven into a workpiece. The tool is actuated by a manually operable trigger that is movable between a rest position and a firing position and includes a workpiece engageable safety member movable between a standby position and an actuating position. Control means for the tool associated with the power mechanism and the trigger enables a drive stroke to be initiated only when the trigger moves from its rest position to its firing position.

The trigger and safety mechanism includes an interlock means associated with both the trigger and the safety member. The interlock means permits the safety member to move from its standby position to its actuating position only when the trigger is in its rest position; permits the trigger to move from its rest position to its firing position only when the safety member is in its actuating position; permits the trigger to return from its firing position to its rest position only when the safety member is in its actuating position; and prevents the safety member from returning from its actuating position to its standby position while the trigger is still in its firing position.

BRIEF DESCRIPTION OF THE DRAWINGS

Many other objects and advantages of the present invention will become apparent from the following detailed description of the embodiment of the invention illustrated in the drawings, wherein.

DETAILED DESCRIPTION OF THE PREFERRED EMBODIMENT

Figure 1:
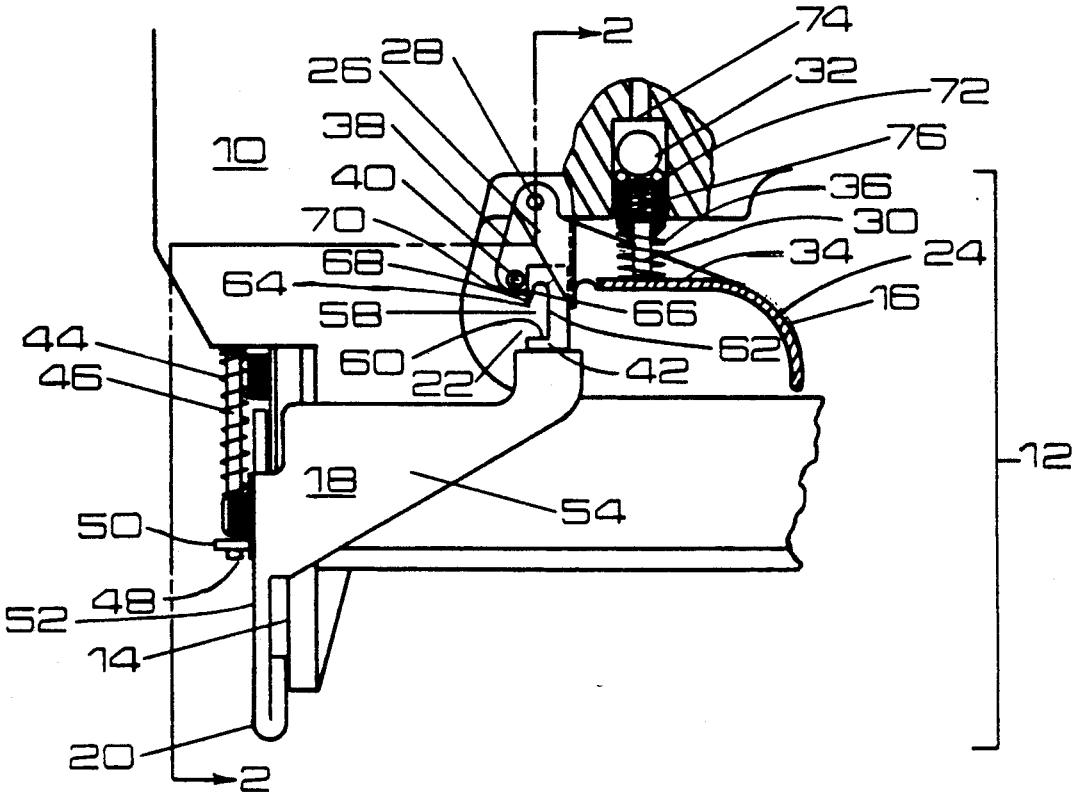
FIG. 1 is a side view of a portion of a fastener driving tool having a safety interlock system embodying the present invention with the safety member being fully extended to its standby position and the trigger being in its rest position.

Referring now more specifically to the drawings, therein is disclosed a fastener driving tool 10 having a trigger and safety mechanism generally designated by the reference numeral 12 and embodying the present invention. The fastener driving tool 10 may be one of several different types of tools known in the art. One such tool is disclosed in U.S. Pat. No. 3,683,746, the assignee of which is the assignee of record of the present application. The disclosure of U.S. Pat. No. 3,683,746 is incorporated by reference herein. The fastener driving tool 10 is operable to drive fasteners (not shown) into a workpiece (also not shown) by ejecting fasteners from a nosepiece or nose portion 14 of the fastener driving tool 10 when the nosepiece 14 is placed against the workpiece.

Figure 2:
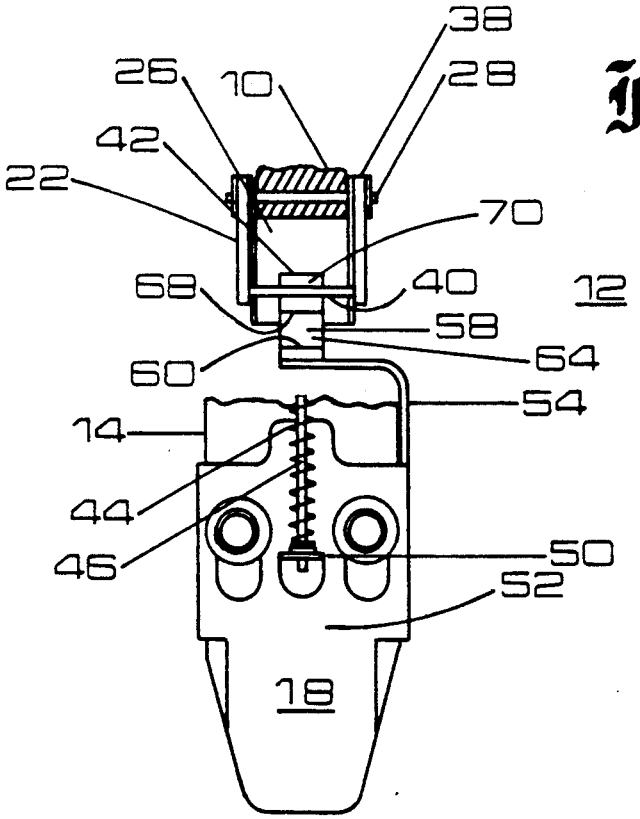
FIG. 2 is a partially cut away, cross sectional front view of FIG. 1 taken along line 2—2 of FIG. 1.
Figure 3:
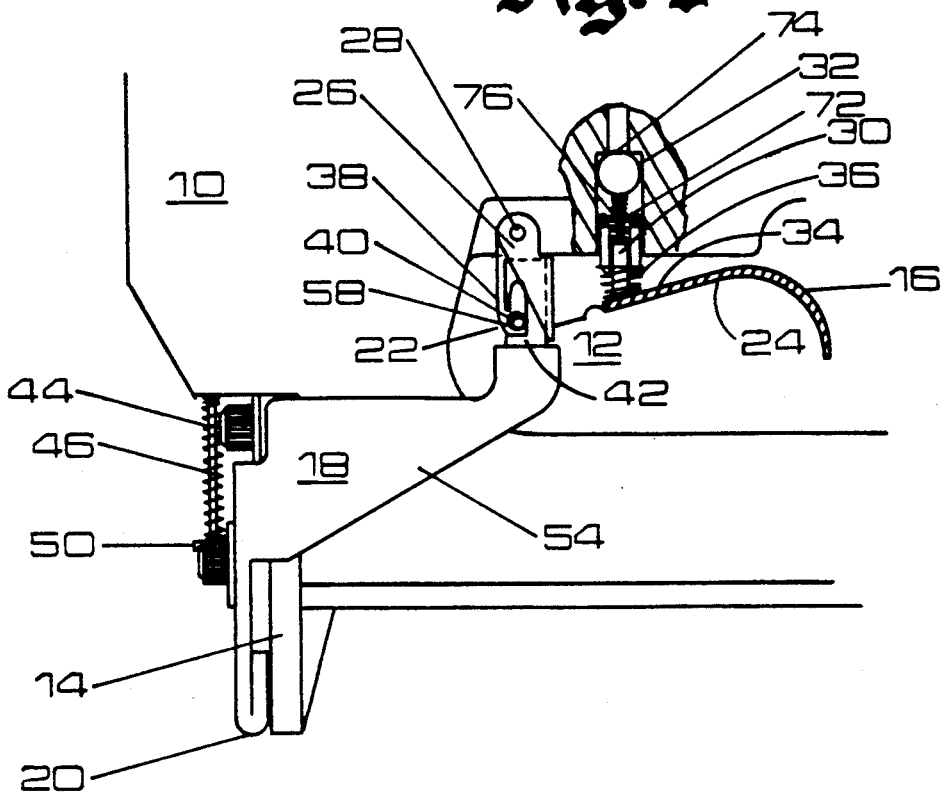
FIG. 3 is a side view similar to FIG. 1 with the safety member being fully depressed to its actuating position and the trigger being fully depressed into its firing position.
Figure 4:
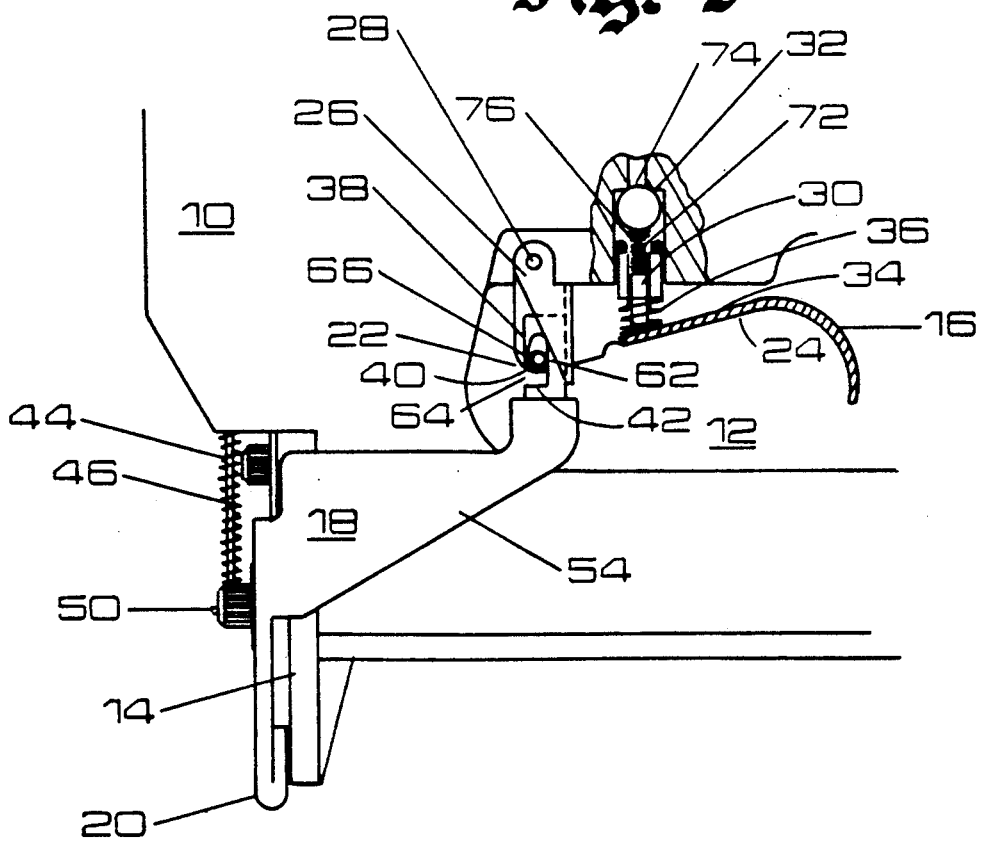
FIG. 4 is a side view similar to FIG. 1 with the safety member being partially relaxed toward its standby position and the trigger being locked in its depressed, firing position.

In order for a fastener to be driven into the workpiece by the fastener driving tool 10, a driving stroke is initiated by depressing a trigger 16 so that the trigger 16 moves from a rest position as illustrated in FIGS. 1–2 to a firing position illustrated in FIGS. 3–4. A manually operable safety member 18 forming a portion of the trigger and safety mechanism 12 is moveably mounted on the nosepiece 14 of the fastener driving tool 10. The safety member 18 moves from a standby position as illustrated in FIGS. 1–2 to an actuating position as illustrated in FIG. 3 when a workpiece engaging portion 20 of the safety member 18 is pushed against a workpiece.

Portions of the trigger 16 and the safety member 18 form an interlock mechanism generally referred to in the drawings by the reference numeral 22. The interlock mechanism 22 insures that (1) the safety member 18 will only move from its standby position to its actuating position when the trigger 16 is in its rest position; (2) the trigger 16 is able to move from its rest position to its firing position only when the safety member 18 is in its actuating position; (3) the trigger 16 is prevented from returning to its rest position from its firing position unless the safety member 18 is in its fully actuated position; and (4) the safety member 18 will not be permitted to return from its actuating position to its standby position when the trigger 16 is in its firing position.

As a result, the interlock mechanism 22 provides the fastener driving tool 10 with two interlocking modes. In one interlocking mode, the trigger 16 cannot be depressed to actuate a driving stroke of the fastener driving tool 10 unless the safety member 18 is placed in its full actuating position by depressing the workpiece engaging portion 20 against the workpiece into which a fastener is to be driven. Moreover, in this interlock mode, the safety member 18 is permitted to move from its actuating position to its standby position only when the trigger 16 is at its rest position. A second interlock mode is provided to prevent the recycling of the fastener driving tool 10 unless the safety member 18 is in its fully actuated position. In this second interlock mode, the trigger 16 is prevented from returning from its firing position to its rest position unless the safety member 18 is at its fully actuated position.

As previously indicated, a driving stroke of the fastener driving tool 10 is initiated by the manual depression of the trigger 16 by an operator. The trigger 16 includes a trigger actuating portion 24 extending from a pivotable portion 26. The pivotable portion 26 is pivotally mounted to the fastener driving tool 10 by a pin or rod 28. When a finger of an operator depresses or actuates the trigger actuating portion 24 and the interlock mechanism 22 is in its first interlock mode with the safety member 18 in its actuated position, the trigger 16 is permitted to rotate about the pin 28 in a counterclockwise direction as the trigger 16 is viewed in FIG. 1 of the drawings and displaces a pin 30 of a trigger valve 32. The displacement of the pin 30 actuates the trigger valve 32 and a driving stroke of the fastener driving tool 10 is initiated. The pin 30 rests on an upper surface 34 of the trigger actuating portion 24. As the trigger 16 is pivoted about the pin 28, the pin 30 will move up and down as it is viewed in the drawings. A biasing spring 36 also biases the trigger 16 towards its rest position.

A trigger interlock portion 38 forms the opposite end of the trigger 16 from the trigger actuating portion 24. The trigger interlock portion 38 also pivots about the pin 28 and includes a trigger rod or pin 40 that has its longitudinal axis generally perpendicular to the longitudinal axis of the trigger 16. As will be described hereinafter, the trigger rod 40 interacts with a safety member interlock portion 42 of the safety member 18 so as to provide the fastener driving tool 10 with the two interlock modes.

The safety member 18 is slidably mounted about the nosepiece 14 of the fastener driving tool 10. It is biased to its standby position shown in FIGS. 1–2 by a biasing spring 44 that is mounted about a pin 46 that extends for the fastener driving tool 10 through a hole 48 in a flange 50 extending from a depending region 52 of the safety member 18. The safety member 18 is generally S-shaped and includes the depending region or linking portion 52 which extends between the workpiece engaging portion 20 and an intermediate portion 54 that extends to the safety member interlock portion 42. The safety member interlock portion 42 is secured to the intermediate portion 54. The safety member interlock portion 42 is formed from a cylindrical body and contains a three-sided cavity 58 having a lower surface 60 and a side surface 62. The surfaces 60 and 62 are perpendicular to each other with the side surface 62 facing the front of the fastener driving tool 10. The lower half of the surface 62 is positioned directly across from a mouth or inlet 64 of the cavity 58. The lower surface 60 is parallel with the horizontal axis of the fastener driving tool 10. An angular or cam surface 66 of the cavity 58 is located on the opposite side of the cavity 58 from the side surface 62 and forms a depending lip 68. The lip 68 defines the upper limit of the mouth 64.

The trigger rod 40 interacts with the safety member interlock portion 42 to provide the fastener driving tool 10 with its two interlock modes. In the one mode illustrated in FIG. 1, the trigger 16 is prevented from pivoting to its firing position because the safety member 18 is not fully depressed to its actuating position. If an operator attempts to depress the trigger 16 when the fastener driving tool 10 is in this inactivated mode, the trigger rod 40 impinges against a rod bearing surface 70 of the safety member interlock portion 42. As a result, the trigger 16 cannot be rotated to depress the pin 30 in order to initiate a driving stroke.

The trigger 16 can be pivoted to its firing position only when the arcuate path of the trigger rod 40 is aligned with the mouth 64 of the cavity 58 of the safety member interlock portion 42. This is shown in FIG. 3 and occurs only when the workpiece engaging portion 20 is fully depressed against a workpiece.

In another mode illustrated in FIG. 4, the trigger 16 is prevented from returning to its spring biased resting position if the spring biased workpiece engaging portion 20 slightly slips towards its standby position, which may occur upon recoil immediately after firing of the fastener driving tool 10. In this instance, the rod 40 of the trigger 16 is latched within the upper portion of the cavity 58 between the cam surface 66 and the side surface 62. As a result, the trigger 16 is immobilized and is prevented from swinging back to its rest position due to the fact that the trigger rod 40 will bear against the cam surface 66. In this mode, the trigger 16 is prevented from moving either clockwise, back to its rest position, or counter-clockwise.

When the trigger 16 is locked in its firing position, a pin 72 axially slidable with respect to the pin 30 maintains the trigger valve 32 against a port 74 so that the port 74 is sealed. The pin 72 is held against the trigger valve 32 by a spring 76. Only when the workpiece engaging portion 20 is fully depressed against a workpiece will the spring biased trigger 16 be permitted to swing back to its resting position so that it may be again depressed to initiate another driving stroke. In this regard, the movement of the trigger 16 to its resting position allows the trigger valve 32 to move away from the port 74 (see FIG. 1) so that the fastener driving tool 10 can be actuated to initiate another driving stroke.

In addition, the interaction of the trigger rod 40 and the safety member interlock portion 42 prevents the safety member 20 from returning to its standby position unless the trigger 16 is in its rest position. Whenever the trigger 16 is in its firing position, the trigger rod 40 is disposed within the cavity 58 of the safety member interlock portion 42. If the workpiece engaging portion 20 is removed from the workpiece prior to the trigger 16 being released to its rest position, the trigger rod 40 remains lodged in the upper portion of the cavity 58 and prevents the safety member interlock portion 42 from moving downward as the fastener driving tool 10 is viewed in the drawings. Consequently, the safety member 18 will not be allowed to return to its standby condition and a fastener will not be inadvertently ejected if the workpiece engaging portion 20 is removed from the workpiece and the trigger 16 is still depressed into its firing position.

Many modifications and variations of the present invention are possible in light of the above teachings. Thus, it is to be understood that, within the scope of the appended claims, the invention may be practiced other than as specifically described above.

What is claimed and desired to be secured by Letters Patent of the United States is:

1. A trigger and safety mechanism for a fastener driving tool having power means operable in a fastener driving stroke during which a fastener is driven into a workpiece, said trigger and safety mechanism comprising:

a manually operable safety member movable between a first safety position and a second safety position;

a manually operable trigger movable between a first trigger position and a second trigger position, said trigger being pivotably mounted on said fastener driving tool;

control means associated with said power means and said trigger for initiating a driving stroke upon the movement of said trigger from said first trigger position to said second trigger position;

safety interlock means having a safety interlock portion associated with said safety member and a trigger safety interlock portion, said trigger safety interlock portion including a rod transversely extending on an end of said trigger opposite to a finger actuating portion of said trigger and being associated with said trigger for preventing said safety member from moving from said first safety position to said second safety position unless said trigger is in said first trigger position; preventing said trigger from moving from said first trigger position to said second trigger position unless said safety member is in said second safety position; preventing said trigger from returning from said second trigger position to said first trigger position unless said safety member is in said second safety position; and preventing said safety member from returning from said second safety position to said first safety position whenever said trigger is in said second trigger position; and a latch cavity included in said safety interlock means and disposed adjacent said rod, said latch cavity having a mouth portion formed between a depending lip portion and a bottom wall of said latch cavity and further having a rod retaining area formed by a cam surface of said lip portion, said rod being permitted to move into and out of said mouth of said latch cavity as said trigger pivots between said first and second trigger positions when said safety member is in said second safety position and being latched in said rod retaining area of said latch cavity when said trigger is in said second trigger position and said safety member is not in said second safety position.

2. A mechanism as recited in claim 1 wherein said latch cavity is in part formed with an outer wall on said depending lip portion, said outer wall having a rod bearing surface and said rod is prevented from entering said mouth of said latch cavity when an attempt is made to move said trigger from said first trigger position to said second trigger position unless said safety member is in said second trigger position such that said trigger is prevented from being moved from said first trigger position to said second trigger position unless said safety member is in said second trigger position.

3. A mechanism as recited in claim 1 wherein said rod is positioned in said rod retaining area of said latch cavity whenever said trigger is in said second trigger position such that said rod prevents said safety member from returning to said first safety position from said second safety position whenever said trigger is in said second trigger position.

4. A mechanism as recited in claim 1 including biasing means to bias said trigger toward said first trigger position.

5. A mechanism as recited in claim 1 wherein the safety member is slidably attached to the fastener driving tool and includes a safety member biasing means biasing said safety member towards its first safety position.

6. A mechanism as recited in claim 1 including first pin means biasing said trigger and second pin means axially slidable with respect to said first pin means and biased against a trigger valve means, said trigger valve means being moved to a closed sealing position by the interaction of said first and second pin means when said trigger moves to said second trigger position.

7. A mechanism as recited in claim 6 including first spring means biasing said first pin means against said trigger and second spring means biasing said second pin means against said trigger valve means.

* * * * *

UNITED STATES PATENT AND TRADEMARK OFFICE

CERTIFICATE OF CORRECTION

PATENT NO. : 5,035,354

DATED : July 30, 1991

INVENTOR(S) : Robert J. Meyer

It is certified that error appears in the above-identified patent and that said Letters Patent is hereby corrected as shown below:

ON TITLE PAGE: Item [73] Assignee "Duo-Fast Corporation, Franklin Park, Utah" should read --Duo-Fast Corporation, Franklin Park, Illinois--.

Signed and Sealed this

Fifth Day of November, 1991

*Attest:*

HARRY F. MANBECK, JR.

*Attesting Officer*

*Commissioner of Patents and Trademarks*